US007414590B2

(12) United States Patent
Bij De Vaate et al.

(10) Patent No.: US 7,414,590 B2
(45) Date of Patent: Aug. 19, 2008

(54) DUAL POLARISED ANTENNA DEVICE FOR AN ANTENNA ARRAY AND METHOD FOR MANUFACTURING THE SAME

(75) Inventors: Jan Geralt Bij De Vaate, Diever (NL); Johannes Henricus Pragt, Coevorden (NL); Huub Ehlhardt, Den Bosch (NL)

(73) Assignee: Stichting Astron, Dwingeloo (NL)

( * ) Notice: Subject to any disclaimer, the term of this patent is extended or adjusted under 35 U.S.C. 154(b) by 22 days.

(21) Appl. No.: 10/565,722

(22) PCT Filed: Jul. 6, 2004

(86) PCT No.: PCT/NL2004/000481

§ 371 (c)(1),
(2), (4) Date: Jun. 5, 2006

(87) PCT Pub. No.: WO2005/011057

PCT Pub. Date: Feb. 3, 2005

(65) Prior Publication Data

US 2006/0273974 A1 Dec. 7, 2006

(30) Foreign Application Priority Data

Jul. 25, 2003 (NL) ..... 1024005

(51) Int. Cl.
*H01Q 13/10* (2006.01)

(52) U.S. Cl. ..... 343/770; 343/770; 343/853

(58) Field of Classification Search ..... 343/767, 343/770, 853

See application file for complete search history.

(56) References Cited

U.S. PATENT DOCUMENTS

| | | | | |
|---|---|---|---|---|
| 2,514,992 | A | 7/1950 | Edelsohn | 250/33 |
| 4,843,403 | A | 6/1989 | Lalezari et al. | 343/167 |
| 5,227,808 | A | 7/1993 | Davis | 343/915 |
| 5,786,792 | A | 7/1998 | Bellus et al. | 343/770 |
| 6,424,313 | B1 | 7/2002 | Navarro et al. | 343/853 |
| 6,518,932 | B1 * | 2/2003 | Matsui et al. | 343/770 |
| 7,057,563 | B2 * | 6/2006 | Cox et al. | 343/700 MS |

FOREIGN PATENT DOCUMENTS

| | | |
|---|---|---|
| EP | 0 349 069 | 1/1990 |
| GB | 1 601 441 | 10/1981 |

OTHER PUBLICATIONS

Chio et al, "Large Wideband Dual-Polarized Array of Vivaldi Antennas with Radome", *IEEE*, (© 1999), pp. 92-95.

* cited by examiner

*Primary Examiner*—Trinh Vo Dinh
*Assistant Examiner*—Dieu Hien T Duong
(74) *Attorney, Agent, or Firm*—Michaelson & Associates; Peter L. Michaelson

(57) ABSTRACT

An antenna device has a sheet-shaped support which is folded along various fold-lines. The support includes a first support plane adjacent to one of the fold-lines and a second support place adjacent to the same fold-line. The first and second support places have first and second antenna structures, respectively, each arranged for receiving or emitting electro-magnetic radiation. The second support plane is positioned at an angle with respect to the first support plane. The second antenna structure is sensitive to electro-magnetic radiation which differs in, e.g., polarization from that of electro-magnetic radiation to which the first antenna structure is sensitive.

20 Claims, 5 Drawing Sheets

DUAL POLARISED ANTENNA DEVICE FOR AN ANTENNA ARRAY AND METHOD FOR MANUFACTURING THE SAME

BACKGROUND OF THE INVENTION

1. Field of the Invention

The invention relates to an antenna device. The invention further relates to an antenna array, an intermediate product for an antenna device and a method for manufacturing an antenna device.

2. Description of the Prior Art

Antenna devices are generally known and used for receiving and emitting electro-magnetic radiation and may, for example, be employed in radar and other direction finding systems, astronomical observatories and satellite receiving equipment, for example. Often, an antenna device has to receive or emit electro-magnetic radiation with differing spatial properties, for example electro-magnetic radiation with different directions of polarization or electro-magnetic radiation stemming from different sources (and, accordingly, emitted from different positions).

For instance, for receiving electro-magnetic radiation with different polarizations dual polarized antenna devices are known. A dual polarized phased-array antenna is known, for example, from the European patent publication 0 349 069 A1. This prior art document describes a phased-array antenna having a plurality of antenna elements positioned in a matrix-shaped arrangement. The matrix comprises an assembly of two orthogonal sets of parallel insulating planar supports. Each of the insulating planar supports is provided with a conductive surface layer patterned to form a succession of tapered notch antenna elements. The tapered notch antenna elements are distributed along an outward facing edge of the planar support. Each of the tapered notch antenna elements has a polarization parallel to the planar supports. The phased-array antenna thus comprises two orthogonal sets of line-shaped arrangements of tapered notch antenna elements, of which sets each has a respective, orthogonal polarization.

In the phased-array antenna described in the above mentioned patent publication, the insulating planar supports of each set intersect and engage on the supports of the other set. To that end, the supports are provided with a slot extending from the edge of a planar support to half way across the support. The sets are positioned such that the supports of one set extend in the slots of supports of the other sets. The supports of one set thus intersect and engage with the supports of the other set to form a matrix-shaped support structure.

However, a draw-back of the antenna device described in said patent publication is that each planar support has to be provided with a multitude of slots, in which thereafter the supports of the other sets have to be positioned. Accordingly, manufacturing of the dual polarized phased-array antenna is complex. Furthermore, the planar supports have to be made of a rigid material in order to obtain a support construction with sufficiently high stiffness, which limits the choice of materials which can be used in the antenna device.

SUMMARY OF THE INVENTION

It is an object of the invention to provide an antenna device which can receive or emit electro-magnetic radiation with different spatial properties and which can be manufactured in a relatively simple manner.

Such an antenna device can be manufactured by folding a suitable intermediate product, e.g., a blank. Compared to cutting slots into rigid supports and positioning sets of slotted rigid supports in a matrix arrangement, folding is a simple operation with few steps. The antenna device can receive or emit electro-magnetic radiation with different spatial properties because the first support plane has a first antenna structure and the second support plane is positioned at an angle with respect to the first support plane and has a second antenna structure.

Furthermore, at least one sheet-shaped support is folded along at least one fold-line, which has the additional advantage that the mechanical stiffness of the antenna device is increased. A wider variety of material can thus be used for the supports, since less rigid, even flexible, materials can be used, such as, for instance, a foldable plastic sheet material, such as kapton.

Furthermore, through the present invention, an antenna array can be manufactured in a simple manner by suitably folding one or more intermediate products.

Such an intermediate product is also taught. An antenna device can be manufactured in a simple operation from such intermediate products by suitable folding of the support along one or more fold-lines.

A method of manufacturing such an antenna or antenna array is also taught as well. In such a method, an antenna device or antenna array is manufactured in a simple manner.

BRIEF DESCRIPTION OF THE DRAWINGS

Specific embodiments of the invention are set forth in the dependent claims. Further details, aspects and embodiments of the invention will be described, by way of example only, with reference to the figures in the attached drawings.

DETAILED DESCRIPTION

Figure 1:
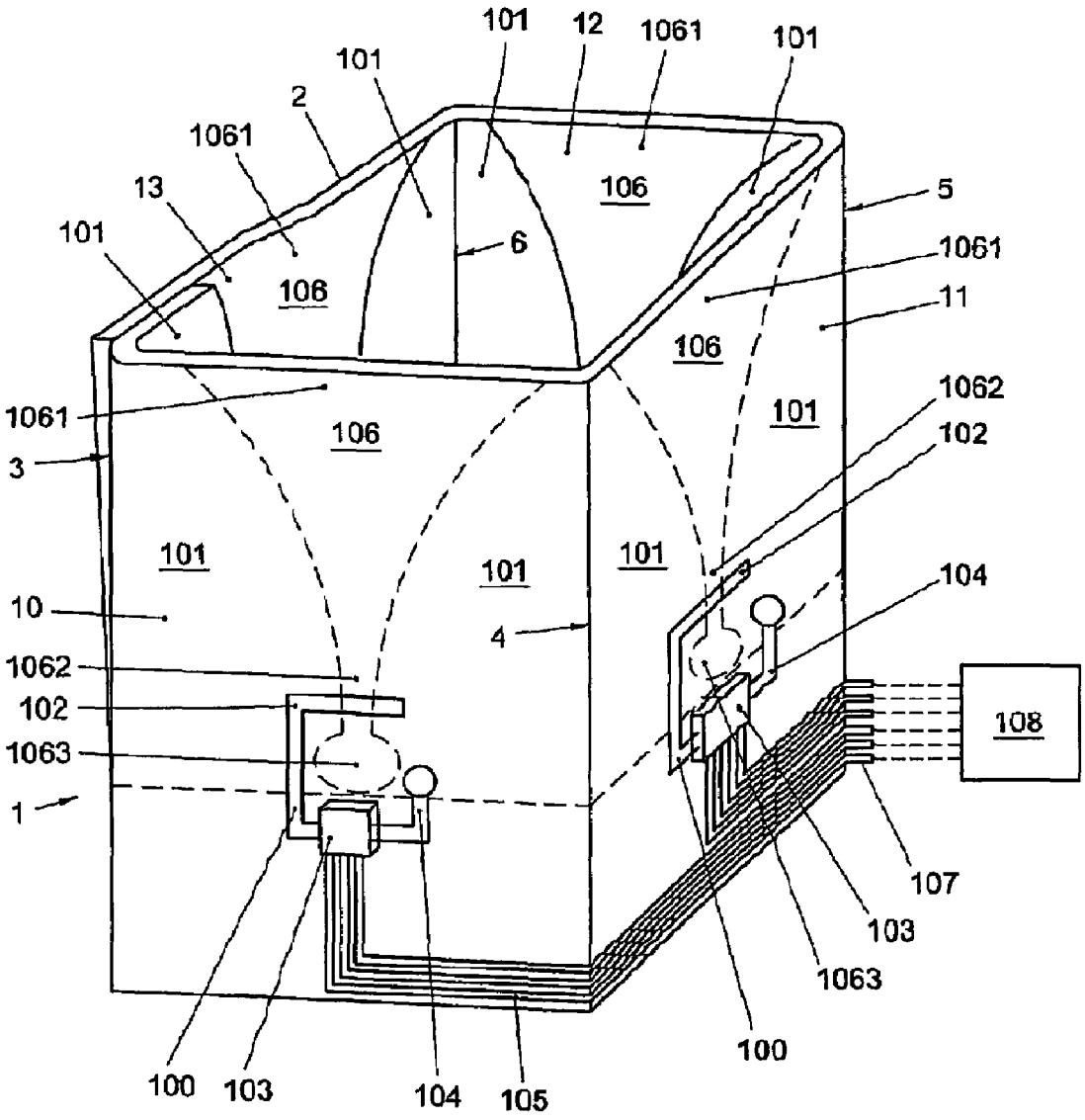
FIG. 1 schematically shows a perspective view of an example of an embodiment of an antenna device according to the invention.

FIG. 1 shows an example of an embodiment of an antenna device 1. The antenna device 1 comprises a sheet-shaped support 2 which is folded along one or more, in this example four, fold-lines 3-6. Support planes 10-13 are present between the fold-lines 3-6, which support planes are obtained by means of the folding.

Each of the support planes 10-13 is provided with an antenna structure 100. In this example, each of the antenna structures 100 has an electro-magnetic polarization direction which is coplanar with the plane of the support plane on which the antenna structure 100 is formed. Thus, by folding the sheet shaped support 2 along the respective fold-lines 3-7, an antenna device with antenna structures 100 is obtained in a simple manner, which can receive or emit spatially different electro-magnetic radiation, e.g., differently polarized radiation.

However, the antenna structures may likewise be sensitive to radiation which differs in another spatial aspect. For example, the antenna structures may be sensitive to electromagnetic radiation from different directions and/or, for example, comprise so called horizontal antennas. Horizontal antennas are flat antennas sensitive to incident radiation with at least a radiation component orthogonal with respect to the plane in which the antennas lie whereas vertical antennas are sensitive to incident radiation with at least a radiation component parallel to the plane of the antennas. Thus, if a sheet-shaped support comprising two or more horizontal antenna structures is folded along fold-lines, such that two or more support planes each with one or more horizontal antenna structures are obtained, the antenna structures on the respective planes are sensitive to radiation from different directions.

The sheet shaped support 2 may be made of any foldable material suitable for the specific implementation. The antenna device 1 has an increased mechanical stiffness because of the fold-lines, which allows the support 2 to be made of a flexible material, which can be folded with a small amount of bending force. The flexible material may for example be a thin plastic foil, kapton, Mylar, Teflon, poly propylene, Poly ethylene or otherwise.

In the example of FIG. 1, the antenna structures 100 include a vertical antenna, but the antenna structures may include other types of antennas. In the example, the antenna structure 100 comprises a patterned conductive surface layer 10 which extends over at least a part of the respective support planes 10-13. The conductive layer 101 is provided with a slot 106. The slot 106 has a tapered shape which narrows from an open, wide end 1061 at an edge of the support plane 10-13 towards a narrow end 1062 at a distance from the edge. At the narrow end, the slot 106 mounds in a circular space 1063.

The antenna structure 100 in the example of FIG. 1 is of a type which is sometimes called a Vivaldi antenna. Such antennas are generally known in the art, for example from the European patent publication 0 349 069 A1 and United Kingdom Patent Number GB 1 601 441. The description of a Vivaldi antenna is hereby assumed to be incorporated herein by way of reference and for this reason the antenna structure will not be further described in detail herein. The Vivaldi antenna element provides an electrical polarization direction which is coplanar with the plane of the dielectric plate on which it is formed.

In the example of FIG. 1, a feed 102 extends across the tapered slot 106 at the narrow end 1062. The feed 102 is connected to an signal input of an amplifier 103, in this example a low noise amplifier, while a reference input of the amplifier 103 is connected to a ground 104. The amplifiers of the antenna structures 100 are further connected to a suitable control circuit and/or signal processing circuit 108 via contact lines 105 and connectors 107. A signal from the feed 102 can for example be transmitted to a signal processing circuit via the amplifier 103, the contact lines 105 and the connectors 107, while a suitable power supply can be provided to the amplifier 103 via the contact lines 105 and the connectors 107.

The connection between the antenna device and additional electronic circuitry may be implemented in any manner suitable for the specific implementation. For instance, a capacitive, inductive or other connection without physical contact can be used.

In the example of FIG. 1, the fold-lines 3-6 are parallel to each other and positioned at equal distances from each other. However, the fold-lines may be positioned in a non-parallel arrangement with respect to each other and/or a different spacing maybe present between the fold-lines. The sheet-shaped support 2 is folded along the fold-lines 3-6 into support planes which are perpendicular to each other. Accordingly, the folded sheet-shaped support 2 encloses a square shaped area. However, the sheet shaped support 2 may likewise be folded in a different manner. For example, the support planes 10-13 may be positioned at another angle with respect to each other, more or less support planes may be present. For instance, three support planes may be provided positioned at an angle of more or less 60 degrees with respect to each other.

In FIG. 1, the sheet-shaped support 2 is folded into a sleeve-like shape, with an open top and bottom. However, the sheet-shaped support 2 may be folded into another shape and/or with more or less open sides. The blank 40 shown in FIG. 2, for example, has, when folded into an antenna device, a closed bottom side which forms a base plane 15 of the antenna device.

Figure 2:
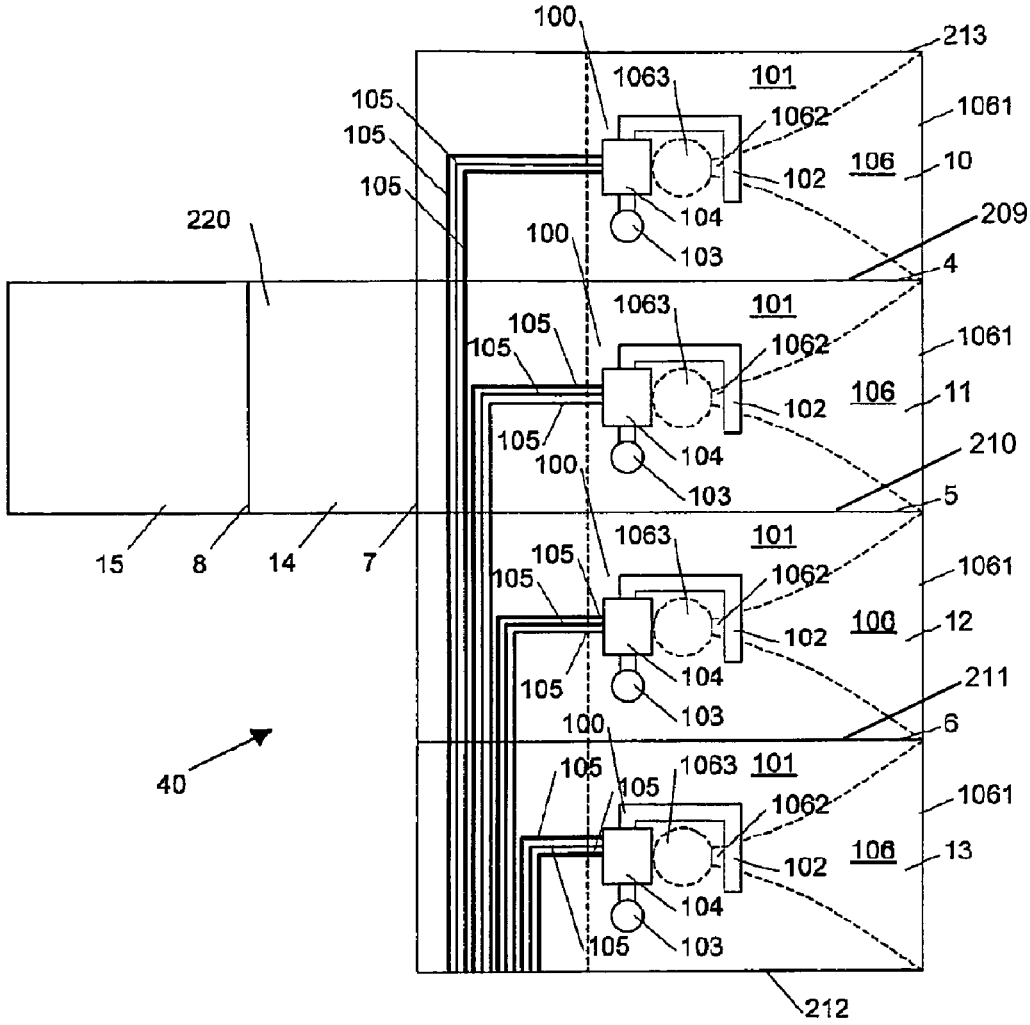
FIG. 2 schematically shows a top view of an example of an embodiment of a semi-finished product suitable for manufacturing an antenna device according to the invention.

FIG. 2 shows a top view of an example of an intermediate product, e.g., a blank 40, which can be folded to obtain an antenna device. The blank 40 comprises an elongated sheet-shaped support 2 provided with two or more, in this example four, flat antenna structures 100 arranged along the longitudinal direction of the sheet shaped support 2. The sheet-shaped support 2 is foldable along fold-lines 4-6 which extend across the sheet-shaped support 2 and along the longitudinal edges 209,210,211,212,213. The fold-lines divide the sheet-shaped support 2 into support planes 10-13, each of which has an antenna structure 100. An antenna device according to the invention can be manufactured from the blank 40 by folding the sheet-shaped support 2 along the fold-lines 4-6, such that the short edges 212,213 of the elongated support 2 are in contact with each other. By folding the blank 40 in this manner, a sleeve-shaped antenna device can be obtained.

In the example of FIG. 2, the support 2 further has along the longitudinal edges 209 and 210 an extension 220 adjacent to the support plane 11. The extension 220 is foldable along fold-line 7 with respect to the rest of the sheet-shaped support 2. The fold-line 7 extends in a direction transverse to the fold-lines 4-6 and parallel to the longitudinal edge 210. The extension 220 further has a fold-line 8 at a distance from and parallel to the fold-line 7. The fold-line 8 divides the extension into a plane 14 and a base plane 15. By suitable folding of the extension 220 along fold-lines 7 and 8, the base plane 15 of the extension 220 can be used as a bottom closure of the sleeve. Thus, a box-shaped antenna device can be obtained. For instance, the plane 14 can be folded along fold-line 7 such that the plane 14 lies parallel to and against the support plane 11. The base plane 15 can then be folded along the fold-line 8 which divides the extension 220, to extend transverse to the support plane 11 and form the base plane of an antenna device.

In the example of FIG. 2, the base plane 15 is covered at one side with a conducting layer, such as for example a metallic layer or otherwise. By suitable folding the extension 220, the base plane 15 can be positioned with its conductive layer in contact with the conductive layer 101 on the support planes 10-13. In such case, the base plane 15 forms the bottom of the box-shaped folded support as well as an electrical base plane for the antennas device. For instance in the example of FIG. 2, the conductive layer 101 of the antenna structures 100 extends over a part of the width of the sheet-shaped support 2 only, as indicated with the dashed line transverse to and located between the longitudinal edges 210,211. The fold-line 8 lies as far from the fold-line 7 as the edge of the conductive layer 101, indicated with the dashed line, lies from the longitudinal edge 1061 of the sheet-shaped support 2. Thus, after folding, the fold-line 8 then lies against the edge of the conductive layer 101, indicated with the dashed line.

The invention is not limited to the arrangement of fold-lines and support planes shown in FIG. 2 and other arrangements are likewise possible. For instance FIGS. 9-12 show, by way of example only, blanks 40 with alternative arrangements of the fold-lines and support planes.

Figure 9:
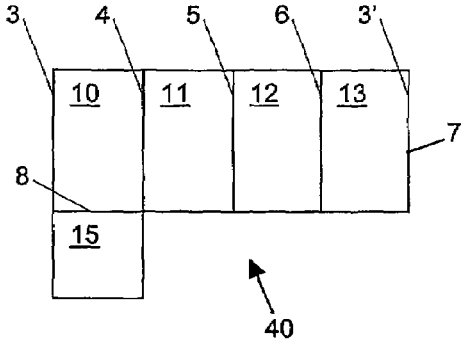
FIGS. 9-12 schematically show some examples of sheet shaped intermediate product suitable for manufacturing an example of an embodiment of an antenna device according to the invention.
Figure 10:
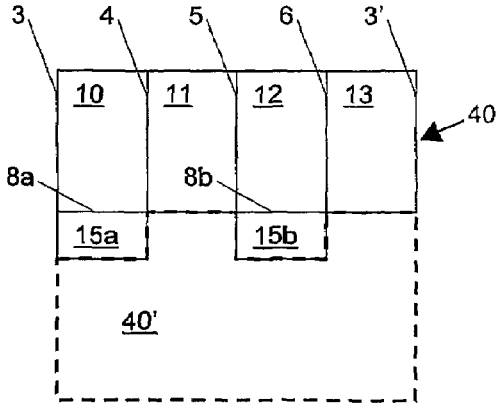

In the example of FIG. 9, the support planes 10-13 are positioned in a line shaped arrangement and foldable along fold-lines 4-7 such that the lines 3,3' at the short ends of the blank 40 are positioned in contact with each other. A base plane extension 15 is positioned at the lowerside of support plane 10 to form the base plane after folding along the fold-line 8. The example of FIG. 10 comprises two base-plane extensions 15*a*, 15*b* which extend over half the length of the base plane after folding. Such an extension arrangement permits the support plane to be manufactured from a band of support plane material with negligible loss of material, because two support planes blanks 40,40' can be cut from the band, as is indicated in FIG. 10 by the dashed lines.

Figure 11:
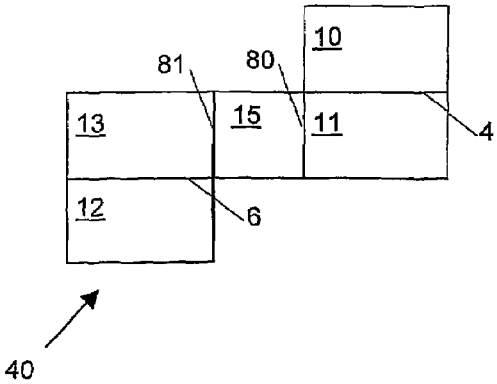
Figure 12:
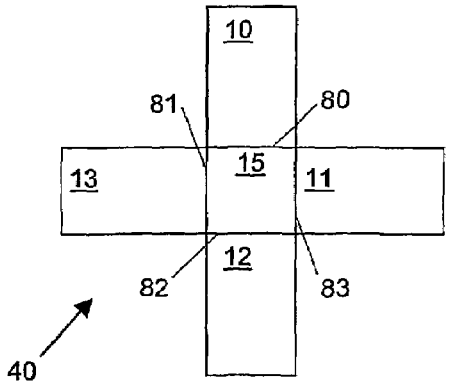

In the example of FIGS. 11 and 12, the support planes 11,13 resp. 10-13 are connected to each other via the base plane which can be formed by folding along fold-lines 80,81 resp. 80-83. Thereby, the respective support planes 13,11 resp. 10-13 adjacent to the base plane 15 are in contact with the base plane, and when the base plane has to be an electrical base plane, electrical contact between the base plane 15 and the adjacent support planes is ensured. Furthermore, the examples of FIGS. 11 and 12 can be modified easily to obtain an antenna device with a frustrated pyramid-like shape by providing the support planes 11,13 resp, 10-13 with a trapezoid shape.

Figure 3:
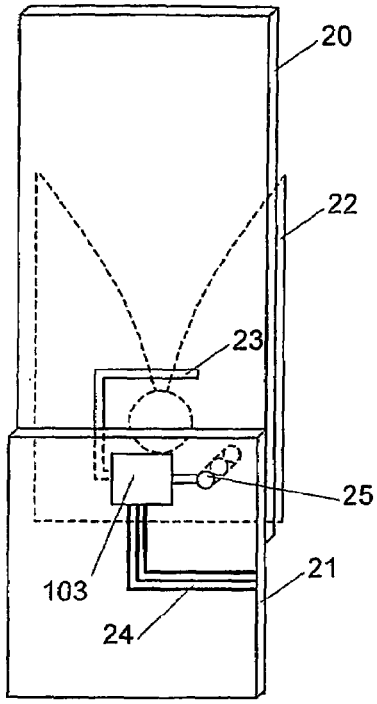
FIG. 3 schematically shows a perspective, partially exploded view of a part of the semi-finished product of FIG. 2.

The antenna structure 100 and the sheet-shaped support 2 may be implemented in any manner suitable for the specific implementation. As shown in FIG. 3, the sheet-shaped support 2 and/or the antenna structures 100 may for instance be a multilayer structure. A multilayer structure can for instance be used to integrate two or more functions of the antenna device. In the example of FIG. 3, the tapered notch antenna, the feed and the connection of the antenna device are integrated.

In FIG. 3, the sheet-shaped support 2 comprises a first electrically insulating layer 20, which may for instance be made out of a plastic material, such as polyethylene, polypropylene, cartboard, kapton or otherwise. The first electrically insulating layer 20 is provided at a backside with a first electrically conductive layer 22.

The first electrically conductive layer 22, for example, may be provided in a relatively simple manner, by adhering a conductive foil, such as aluminum foil, to the backside of the electrically insulating layer 20. Techniques for fixing aluminum foil onto a plastic layer, such as polypropylene or polyethylene, are generally known, for example in the field of packaging food products and are for the sake of brevity not described in further detail. However, the electrically conductive layer 22 may be obtained in any other manner suitable for the specific implementation.

A second electrically conducting layer 23 is present at a front side, opposite to the backside, of the first electrically insulating layer 20. The second electrically conducting layer 23 can, for instance, be strip-shaped and be formed into the feed 102 of an antenna structure 100 suitable for the example of FIG. 1.

The strip-shaped electrically conducting layer 23 lies between the first electrically insulating layer 20 and a second electrically insulating layer 21. A third electrically conducting layer 24 lies on top of the second electrically insulating layer 21, which is shaped into a ground connection of an amplifier 103 or other electronic circuitry present in the antenna structure 100. The ground connection in the third electrically conducting layer 24 is connectable to the first electrically conducting layer 22 by means of a passage 25 in which an electrically conducting pin can be positioned which then connects the first and third electrically conducting layers 22,24 electrically. The third electrically conducting layer is further shaped into connecting lines 105 for transmitting signals from or to the antenna. Thus, the connecting lines 105 are integrated in the flat design of the antenna structures 100. Thereby, the antenna structures 100 can be connected to further circuitry in a simple manner and there is no necessity to connect cables directly to the amplifier 103 of the feed 102.

Figure 4:
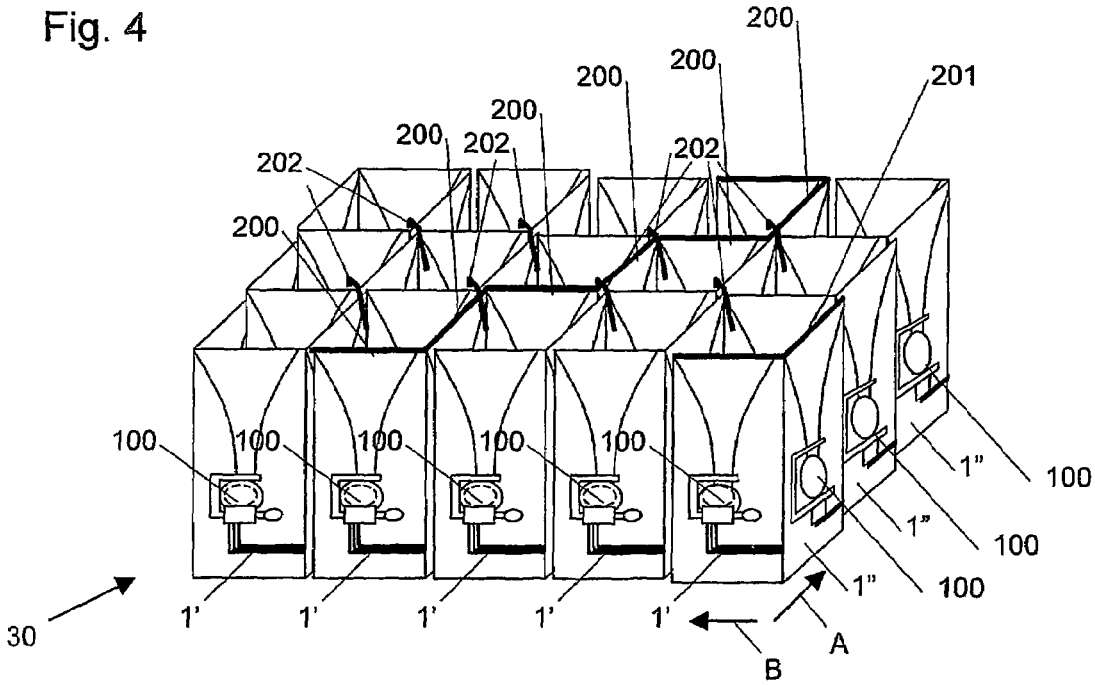
FIG. 4 schematically shows a perspective view of an example of an embodiment of an antenna array according to the invention.

FIG. 4 shows an example of an antenna array 30 which includes two or more examples of antenna devices 1', 1" according to the invention. As indicated in FIG. 4 by way of example with reference numbers 200,201, the antenna array comprises one or more step shaped-folded supports provided with antenna structures. The step-shaped folded supports 200,201 are folded into a number of antenna devices 1', 1" according to the invention. The antenna devices 1', 1" are provided with antenna structures 100 each have an electromagnetic polarization direction which is coplanar with the plane of the support plane on which the antenna structure 100 is formed. The antenna array 30 therefore comprises sets of antenna device 1' resp. 1" with different orthogonal orientations, as indicated with the arrows A and B, and the antenna array 30 is a dual polarized antenna array which can be used to receive or emit electro-magnetic radiation with different polarizations.

Additionally, each set of antenna devices 1' resp. 1" comprises arrangements of antenna device 1' resp. 1" in the direction of arrow A and arrangements in the direction of arrow B. Accordingly, each set forms a matrix-shaped arrangement with a certain polarization and the antenna array 30 shown in FIG. 4 comprises two, intermingled matrix-shaped arrangements each of which has a different polarization.

In FIG. 4, the antenna devices 1'1," are positioned in a two-dimensional matrix shaped arrangement. It should be noted that in general any number of antenna elements may be used and the invention is not limited to the shown number of antenna elements. Furthermore, the antenna elements may likewise be positioned in an arrangement different from the line-shaped arrangement in FIG. 4 such as, depending on the specific implementation, a line-shaped arrangement, a random distribution, a three dimensional arrangement or otherwise.

Figure 5:
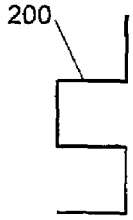
FIGS. 5-8 schematically show examples of folded sheets shaped supports suitable for in an example of an embodiment of an antenna array according to the invention.
Figure 6:
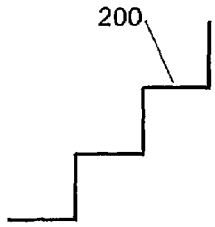
Figure 7:
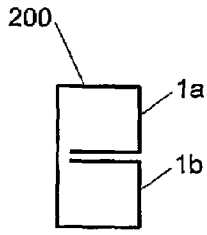
Figure 8:
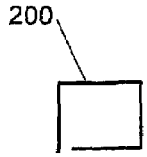

In the example of FIG. 4, the support 200 is folded along more than one fold-line. The support 200 is repeatedly folded along a fold-line in a first direction and in a following fold-line in a second direction perpendicular to the first direction, such that a stair-shaped support is obtained, as is for instance shown in FIG. 6. A number of supports folded in a similar fashion is positioned parallel to the support 200. However, the invention is not limited to the specific manner in which the support 200 is folded. The supports may likewise be folded in another manner. FIG. 5, for example, shows a support 200 which is folded along a first pair of fold-lines in a first direction and a following pair of fold-lines in a second direction, such that the support is locally U-shaped. FIG. 7 shows a support which is first folded along a first set of three equally spaced fold-lines in a first direction and then again along a second set of three equally spaced fold-lines at that same direction, to obtain two sleeve shaped antenna devices 1*a* and 1*b*.

In the antenna array 30 shown in FIG. 4, the supports are attached near the fold-lines to each other by means of clamps 202. Fixation by means of clamps is low-cost and simple. However, the supports may likewise be attached in another manner. For instance, different sheets may be glued to each other in the support planes or otherwise.

The antenna array system shown in FIG. 4 may be implemented as a phased-array antenna. For instance, the different sets of antenna devices 1' resp. 1" may be connected to suitable beam forming and control circuitry. Phased-array antennas are generally known, for instance, from the American patent publication U.S. Pat. No. 6,232,919 and the European patent publication EP 805 509.

Figure 13:
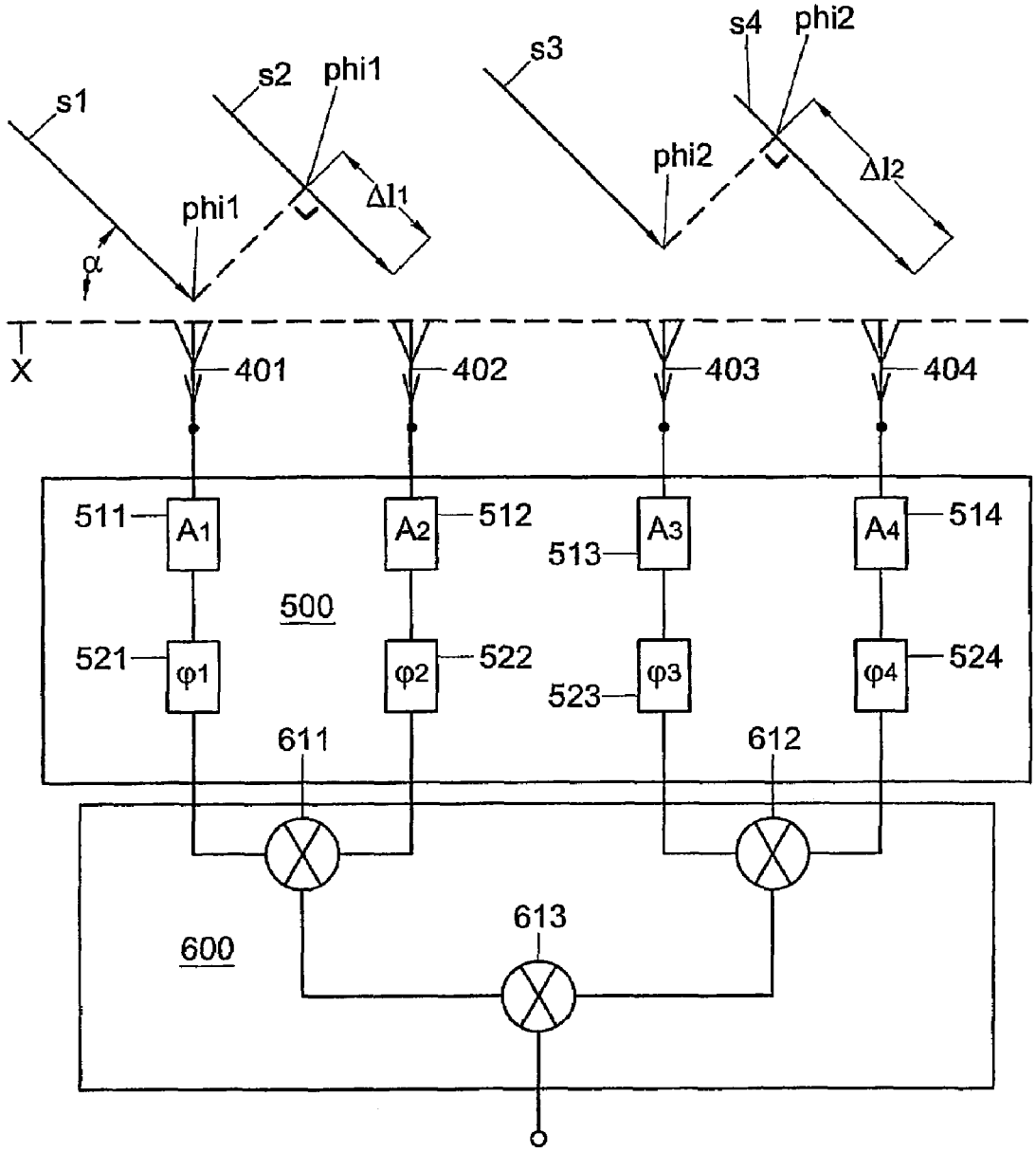
FIG. 13 schematically shows a block diagram of an example of an embodiment of a phased-array antenna.

In FIG. 13, the operation of such an antenna system is illustrated. The antenna system shown comprises, by way of example, four antenna units 401-404 which are arranged next to each other in one line. The antenna units 401-404 are each connected with an amplifier device 511-514, respectively. The amplifier devices 511-514 are each connected with a respective time- or phase-shifting circuit 521-524. The time- or phase-shifting circuits 521-524 are connected with each other through combining circuits 611-613 in an electronic circuit 600. The antenna system shown in FIG. 4 could be designed as a phased-array antenna system, for instance, by adding time- or phase-shifting circuits, for instance, via different lengths of the contact lines 105, implementing the amplifier devices 103 in the signal processing circuit 500 and connecting the contact lines 105 to a suitable electronic circuit.

The antenna units 401-404 can receive electro-magnetic radiation which reaches the antenna at an angle which is within the viewing range. In FIG. 13 a bundle of electro-magnetic radiation is shown which is built up from four parallel rays s1-s4. In the example shown, the ray s1 incident on the antenna unit 401 has a phase phi1. The ray s2 incident on the antenna unit 402, however, must cover an additional distance $\Delta l_1$, which is equal to the distance between the antenna units multiplied by the cosine of the angle $\alpha$ which the rays make with the plane X in which the antenna units are situated. As a result, the ray s2 has a phase-shift relative to the ray s1 at the moment when the antenna is reached. The phases of the rays s3 and s4 differ similarly. In the antenna system, this phase-shift can be compensated by setting the phase- or time-shift of the phase- or time-shifting circuits 521-524 such that the mutual differences thereof correspond to the phase differences in the incoming rays. In this way, because the phase- or time-shift depends on the angle of the incoming radiation, the direction in which the antenna system receives can be adjusted.

By designing an antenna system according to the invention as a phased-array antenna, an inexpensive antenna unit is obtained which can be simply directed electronically at a source by setting the time- or phase-shifting circuits. Moreover, several sources can be received simultaneously by connecting each of the antenna units with several time- or phase-shifting circuits and setting a separate shift for each source to be received. Further, with a phased-array antenna, a rotation of the antenna system relative to the source can be automatically compensated electronically. For instance, satellite receivers mounted on ships and trucks, and in general on moving carriers, are subject to such rotation, so that the known receiver, at least the antennas thereof, must be held in position mechanically. With a phased-array antenna system as proposed, this mechanical compensation can be replaced with an electronic compensation which is cheaper and more wear-resistant than the former.

It should be noted that the above-mentioned embodiments illustrate rather than limit the invention, and that those skilled in the art will be able to design alternatives without departing from the scope of the appended claims. For instance, a line of weakness may be provided to the sheet shaped support to facilitate folding. Also, the fold-lines may, for example, be provided at other positions of the support than shown and/or the support planes may be oriented differently with respect to each other. Furthermore, the antenna device may, for example, comprise more or fewer support planes than shown herein. Also, the antenna device may be positioned in recesses of a cover which shields the antenna device from environmental influences, such as water, temperature or otherwise. Such a cover may, for example, be made of a foam material and, for instance, be provided with one or more slots corresponding to the shape of the support. Other variations and modifications are likewise possible and features from different embodiments may be combined.

The word 'comprising' does not exclude the presence of other elements or steps than those listed in a claim. Unless explicitly specified otherwise, the word 'a' is used as including one, two, three, or more of the specified elements. The mere fact that certain measures are recited in mutually different claims does not indicate that a combination of these measures cannot be used to advantage.

The invention claimed is:

1. An antenna array comprising:

first and second separate sheet-shaped supports, wherein each of the first and second sheet-shaped supports is folded along corresponding first and second fold-lines in said first and second sheet-shaped supports, respectively, so as to form through each of said first and second sheet-shaped supports:

a first support plane, in each one of the first and second sheet-shaped supports and respectively along said first and second ones of the fold-lines, having a first antenna structure arranged for receiving or emitting electro-magnetic radiation; and a second support plane, in each one of the first and second sheet-shaped supports and adjacent to said first support plane therein and respectively along said first and second ones of the fold-lines, the second support plane in said each one of the first and second sheet-shaped supports being positioned at an angle with respect to the first support plane also in said each one of the first and second sheet-shaped supports, respectively, and having a second antenna structure arranged for receiving or emitting electro-magnetic radiation which differs in at least one property from the electro-magnetic radiation which is received or emitted by the first antenna structure; and wherein the first and second sheet-shaped supports are physically connected to each other at or near the first and second fold-lines.

2. The antenna array as recited in claim 1 wherein the first sheet-shaped support is folded along two separate fold-lines.

3. The antenna array as recited in claim 2 further comprising, for the first sheet-shaped support, a base plane adjacent to a side of one of said two separate fold-lines in the first sheet-shaped support, one of the first and second support planes being adjacent to another side of said one of said two separate fold-lines, and said base plane being positioned at an angle with respect to the first and second support planes.

4. The antenna array as recited in claim 3 wherein the first conducting layer extends over a portion of the base plane.

5. The antenna array as recited in claim 3 wherein the base plane is substantially rectangular, said first support plane is positioned at a first side of the rectangular base plane and said second support plane is positioned at a second side of the rectangular base plane transverse to the first side.

6. The antenna array as recited in claim 1 wherein:

the first antenna structure is arranged for receiving or emitting electro-magnetic radiation of a first polarization; and the second antenna structure is arranged for receiving or emitting electro-magnetic radiation of a second polarization different from the first polarization.

7. The antenna array as recited in claim 1 wherein one of the first and second sheet-shaped supports comprises a first electrically insulating layer.

8. The antenna array as recited in claim 7 wherein the first electrically insulating layer comprises a flexible material.

9. The antenna array as recited in claim 7 further comprising:

a first electrically conducting layer located at a first side of the first electrically insulating layer; and a second electrically conducting layer located at a second side of the first electrically insulating layer and shaped into a feed.

10. The antenna array as recited in claim 9 further comprising a third electrically conducting layer situated at the second side of the first electrically insulating layer and shaped into connecting lines for transmitting signals from or to the first antenna structure.

11. The antenna array as recited in claim 10 wherein:

the feed lies between the first electrically insulating layer and a second electrically insulating layer; and the connecting lines are present at a side of the second electrically insulating layer facing away from the first electrically insulating layer.

12. The antenna array as recited in claim 9 further comprising an amplifier element positioned at the second side of the first electrically insulating layer, said amplifier element having signal and reference inputs, the signal input being connected to the feed and the reference input being connected to ground.

13. The antenna array as recited in claim 9 wherein the first electrically conducting layer is used as ground.

14. The antenna array as recited in claim 1 wherein the first and second antenna structures comprise flat antennas.

15. The antenna array as recited in claim 14 wherein the first and second antenna structures comprise vertical antennas which are sensitive to incident radiation with a radiation component parallel to respective planes in which the first and second antenna structures are oriented.

16. The antenna array as recited in claim 15 wherein the first and second antenna structures comprise tapered slot antennas.

17. The antenna array as recited in claim 3 wherein the first sheet-shaped support is folded along said one of said two separate fold-lines such that one of the first support plane, the second support plane and the base plane, so as to collectively define three planes, is positioned substantially perpendicular to one of the other ones of said three planes.

18. The antenna array as recited in claim 1 wherein the first sheet-shaped support is folded to a sleeve-like shape.

19. The antenna array as recited in claim 1 wherein either said first or said second antenna structures is connectable, via a non-contact connection, to a signal processing device externally situated to the antenna array.

20. A method for manufacturing an antenna array comprising the steps of:

folding each of first and second sheet-shaped supports along corresponding first and second fold-lines in said first and second sheet-shaped supports so as to form:

a first support plane, in each one of the first and second sheet-shaped supports and respectively along said first and second ones of the fold-lines, having a first antenna structure arranged for receiving or emitting electro-magnetic radiation; and a second support plane, in each one of the first and second sheet-shaped supports and adjacent to said first support plane therein and respectively along said first and second ones of the fold-lines, the second support plane in said each one of the first and second sheet-shaped supports being positioned at an angle with respect to the first support plane also in said each one of the first and second sheet-shaped supports, respectively, and having a second antenna structure arranged for receiving or emitting electro-magnetic radiation which differs in at least one property from the electro-magnetic radiation which is received or emitted by the first antenna structure; and wherein the first and second sheet-shaped supports are physically connected to each other at or near the first and second fold-lines.

* * * * *